US005992423A

United States Patent [19]

Tevolini

[11] Patent Number: 5,992,423

[45] Date of Patent: Nov. 30, 1999

[54] DETACHABLE HAIRBRUSH

[76] Inventor: Gennaro Tevolini, 165 Seaside Ave., Unit 1, Stamford, Conn. 06902

[21] Appl. No.: 09/226,298

[22] Filed: Jan. 7, 1999

[51] Int. Cl.[6] ..... A45D 24/00

[52] U.S. Cl. ..... 132/200; 132/313; 132/120; 15/144.4; 15/176.1

[58] Field of Search ..... 132/265, 262, 132/120, 122, 150, 200, 223, 226, 266, 267, 238, 239, 313, 233; 15/144.4, 176.1, 207.2, 105, 176.2, 176.3–176.6

[56] References Cited

U.S. PATENT DOCUMENTS

| | | |
|---|---|---|
| D. 324,454 | 3/1992 | Herron . |
| 2,463,390 | 3/1949 | Jacobowitz et al. . |
| 2,595,645 | 5/1952 | Davis et al. . |
| 3,083,715 | 4/1963 | Trabish . |
| 3,150,393 | 9/1964 | Taylor et al. . |
| 3,421,522 | 1/1969 | Magguilli . |
| 3,871,391 | 3/1975 | Boudal . |
| 3,894,549 | 7/1975 | Scivoletto . |
| 3,955,064 | 5/1976 | Demetrio et al. . |
| 3,967,630 | 7/1976 | Zuhlsdorff et al. . |
| 3,991,776 | 11/1976 | Duffy . |
| 4,032,747 | 6/1977 | Kunz . |
| 4,166,472 | 9/1979 | Battaglia . |
| 4,243,061 | 1/1981 | Buchanan . |
| 4,605,023 | 8/1986 | Modin . |
| 5,479,951 | 1/1996 | Denebeim . |
| 5,603,339 | 2/1997 | Brazeal et al. . |

*Primary Examiner*—Gene Mancene
*Assistant Examiner*—Pedro Philogene
*Attorney, Agent, or Firm*—St. Onge Steward Johnston & Reens LLC

[57] ABSTRACT

A hairbrush is provided which includes a brush head that is detachable from the handle whereby numerous brush heads may be rolled into the hair and the handle removed such that the detached brush heads may act as curlers. The hairbrush includes a handle with a polygonal socket tool extending therefrom. A detent, preferably a spring loaded ball detent, protrudes from one of the side walls of the socket tool. The hairbrush also includes a brush head having a central core. An end wall of the central core defines a socket which is sized and shaped to receive the socket tool. A ridge defined by the socket engages the detent when the socket tool is inserted in the socket. Preferably, the hairbrush also includes a retraction mechanism for retracting the detent so that when the retraction mechanism is actuated the detent no longer engages the ridge of the socket. Most preferably, the retraction mechanism comprises a button protruding through an outer longitudinal surface of the handle so that the detent is retracted when the button is depressed.

12 Claims, 2 Drawing Sheets

DETACHABLE HAIRBRUSH

FIELD OF THE INVENTION

The present invention relates to a detachable hairbrush, and more particularly to a hairbrush including a brush head which is detachable from the handle whereby numerous brush heads may be rolled into the hair and the handle removed such that the detached brush heads may act as curlers.

BACKGROUND OF THE INVENTION

Hairbrushes and other hair care implements having detachable handles are well known. Such products have long been used where it is desirable to have several interchangeable heads with varying properties and purposes. Such products have also been used as an effective and efficient means for inserting rollers or curlers into the hair. When used for this purpose, the handle and roller are attached and the roller is tightly curled into the hair. Once inserted, the handle is removed from the roller, inserted into another roller, and the process is repeated. However, although devices of this type are known, certain deficiencies in the prior art designs exist.

U.S. Pat. No. 3,871,391 to Boudal discloses a hair roller having a central cylindrical support on which are mounted tufts of bristles. The patent envisions a handle which may be removably attached to the roller, but no disclosure is made as to how such attachment can be accomplished.

U.S. Pat. No. 5,603,339 to Brazeal et al. discloses a motorized rotating comb device. The comb includes a polygonal bit which engages a corresponding chuck in the rotating means. A spring-loaded ball detent projects from a side of the polygonal bit and engages a detent recess within the chuck. The patent does not disclose, however, a bristle hairbrush or curler.

U.S. Pat. No. 2,463,390 to Jacobowitz et al. discloses a hairbrush which includes interchangeable recurling implements attached to a handle by a mating male and female thread arrangement. U.S. Pat. No. 5,479,951 to Denebeim discloses a bendable, extendable hairbrush with a removable brush head. The brush head is attached to the handle either by a bayonet connection or by a conical friction connection. A disadvantage of Jacobowitz and of the bayonet connection embodiment of Denebeim is that the handle cannot be easily separated from the brush head. When one is attempting to roll multiple curlers into the hair, quick and easy separation of the handle is desirable. Most desirable is the ability to separate the handle from the brush head with one hand so that another brush head can be held ready in the other hand. This cannot be accomplished with Jacobowitz or with the bayonet connection embodiment of Denebeim. A disadvantage of the conical friction connection embodiment of Denebeim is that the brush head may be rotable and/or become detached from the handle before detachment is desired. To properly act as curlers, the brush heads must be wound tightly into the hair. A conical friction connection may allow for rotation of the roller due to the tangential forces exerted by the hair upon the roller. These same tangential forces may lead to the premature and unintentional separation of the brush head from the handle.

U.S. Pat. No. 3,967,630 to Zuhlsdorff et al. discloses a bristle hairbrush and curler combination with a removable handle. In one embodiment the handle includes a central mandrel which engages a corresponding central cavity of the curler element. The mandrel extends substantially to the end of the curler element, and attachment is accomplished by frictional engagement. A disadvantage of Zuhlsdorff is that the handle may not be easily separable from the curler element with one hand. One hand would be required to grasp the curler element, while the other hand would be used to pull free the handle. Moreover, a substantial amount of force may be necessary to overcome the frictional engagement between the mandrel and the central cavity. In addition to hindering separation, this may lead to discomfort or even injury to the user's scalp as the handle is pulled free, since pulling of the user's hair which is wound around the curler element is possible.

What is desired, therefore, is a hairbrush which includes a brush head that is detachable from the handle whereby numerous brush heads may be rolled into the hair and the handle removed such that the detached brush heads may act as curlers, which allows for quick and easy separation of the handle and the brush head, which inhibits the brush head from rotating about the handle, which inhibits separation of the brush head from the handle before detachment is desired, which allows for separation of the brush head and handle without requiring a substantial force, and which allows for separation of the handle from the brush head with one hand so that another brush head can be held ready in the other hand.

SUMMARY OF THE INVENTION

Accordingly, it is an object of the present invention to provide a hairbrush which includes a brush head that is detachable from the handle whereby numerous brush heads may be rolled into the hair and the handle removed such that the detached brush heads may act as curlers.

Another object of the present invention is to provide a hairbrush having the above characteristics and which allows for quick and easy separation of the handle and the brush head.

A further object of the present invention is to provide a hairbrush having the above characteristics and which inhibits the brush head from rotating about the handle.

Still another object of the present invention is to provide a hairbrush having the above characteristics and which inhibits separation of the brush head from the handle before detachment is desired.

Yet a further object of the present invention is to provide a hairbrush having the above characteristics and which allows for separation of the brush head and handle without requiring a substantial force.

Yet another object of the present invention is to provide a hairbrush having the above characteristics and which allows for separation of the handle from the brush head with one hand so that another brush head can be held ready in the other hand These and other objects of the present invention are achieved by provision of a hairbrush having a handle with a polygonal socket tool extending therefrom. A detent, preferably a spring loaded ball detent, protrudes from one of the side walls of the socket tool. The hairbrush also includes a brush head having a central core. An end wall of the central core defines a socket which is sized and shaped to receive the socket tool. A ridge defined by the socket engages the detent when the socket tool is inserted in the socket. Preferably, the hairbrush also includes a retraction mechanism for retracting the detent so that when the retraction mechanism is actuated the detent no longer engages the ridge of the socket. Most preferably, the retraction mechanism comprises a button protruding through an outer longitudinal surface of the handle so that the detent is retracted when the button is depressed.

The invention and its particular features and advantages will become more apparent from the following detailed description considered with reference to the accompanying drawings.

DETAILED DESCRIPTION OF THE INVENTION

Figure 1:
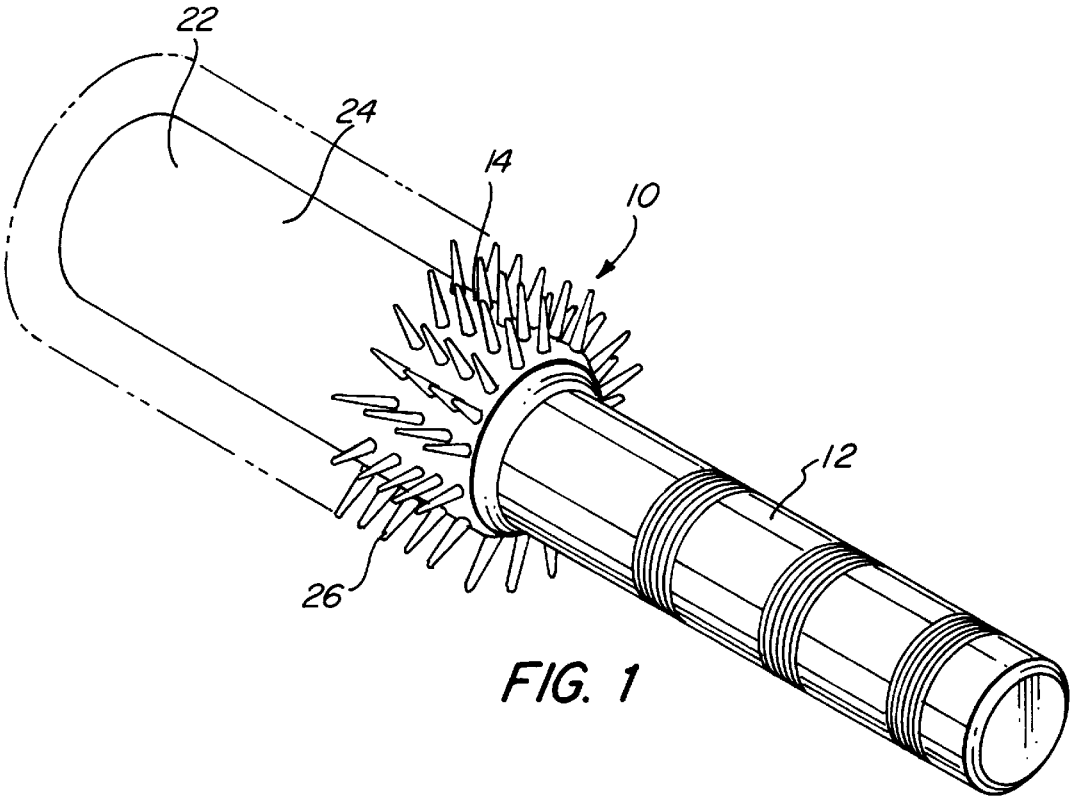
FIG. 1 is an isometric view of a hairbrush in accordance with the present invention shown with the brush head attached to the handle and with a portion of the bristles cut away.
Figure 2:
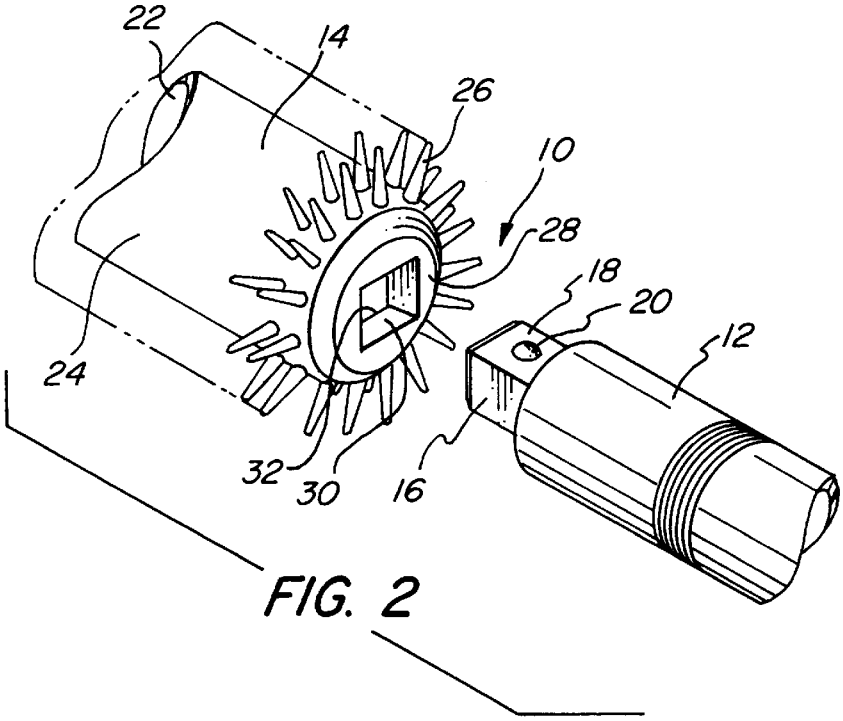
FIG. 2 is an isometric view of a portion of the hairbrush of FIG. 1 shown with the brush head detached from the handle and with a portion of the bristles cut away.

Referring first to FIGS. 1 and 2, a hairbrush 10 in accordance with the present invention is shown. Hairbrush 10 is comprised generally of a handle 12 and a brush head 14. Handle 12 is sized and shaped to fit easily within the grasp of a user, with numerous configurations being possible. A generally cylindrical handle 12 is shown in the Figures. Extending from an end of handle 12 is a polygonal socket tool 16 having a plurality of side walls 18. A detent 20, preferably a spring loaded ball detent, protrudes from one of side walls 18 of socket tool 16. By spring loaded ball detent, what is meant is a generally spherical member disposed within socket tool 16 such that the member is biased toward a hole in one of side walls 18 so that a portion of the member protrudes through the hole in the side wall, and such that the member is movable against the bias so that substantially no portion of the member protrudes through the hole in the side wall.

Brush head 14 includes a central core 22 having an outer longitudinal surface 24 with a plurality of radially oriented bristles 26 attached thereto as is commonly known, and also having an end wall 28. End wall 28 defines a socket 30 which is sized and shaped to receive socket tool 16. More specifically, socket 30 has a shape substantially identical to the shape of socket tool 16, with the dimensions of socket 30 being only slightly larger. Thus, there is substantially no play or wobbling between brush head 14 and handle 12 once socket tool 16 is inserted in socket 30. Socket 30 defines a ridge 32 therein such that detent 20 engages ridge 32 when socket tool 16 is inserted in socket 30.

The close fit between socket tool 16 and socket 30 causes socket 30 to exert a force upon detent 20 as socket tool 16 is being inserted into socket 30, thereby causing detent 20 to retract. Once socket tool 16 is fully inserted into socket 20, detent 20 has moved beyond ridge 32 and again protrudes out of side wall 18 to engage ridge 32, thereby holding brush head 14 onto handle 12. To separate brush head 14 from handle 12 in this embodiment, the user simply exerts a separating force on handle 12, brush head 14 or both handle 12 and brush head 14. This force causes socket 30 to exert a force upon detent 20, thereby causing detent 20 to retract, so that socket tool 16 can be slid out of socket 30, thereby separating handle 12 and brush head 14. This arrangement allows for quick and easy separation of handle 12 and brush head 14 and inhibits separation of brush head 14 from handle 12 before detachment is desired.

Although polygonal socket tool 16 may have any of a number of sides, polygonal socket tool 16 preferably comprises a square socket tool having four side walls 18. A square socket tool is desirable because of the ease of incorporating detent 20 into such a design as compared to a triangular socket tool and because the greater the number of sides over four, the less the force necessary to deform the socket enough to allow brush head 14 to rotate relative to handle 12. Rotation of brush head 14 relative to handle 12 makes insertion of brush head 14 into the hair difficult, and is thus undesirable. A polygonal, and particularly a square, socket tool thus inhibits brush head 14 from rotating about handle 12.

Figure 3:
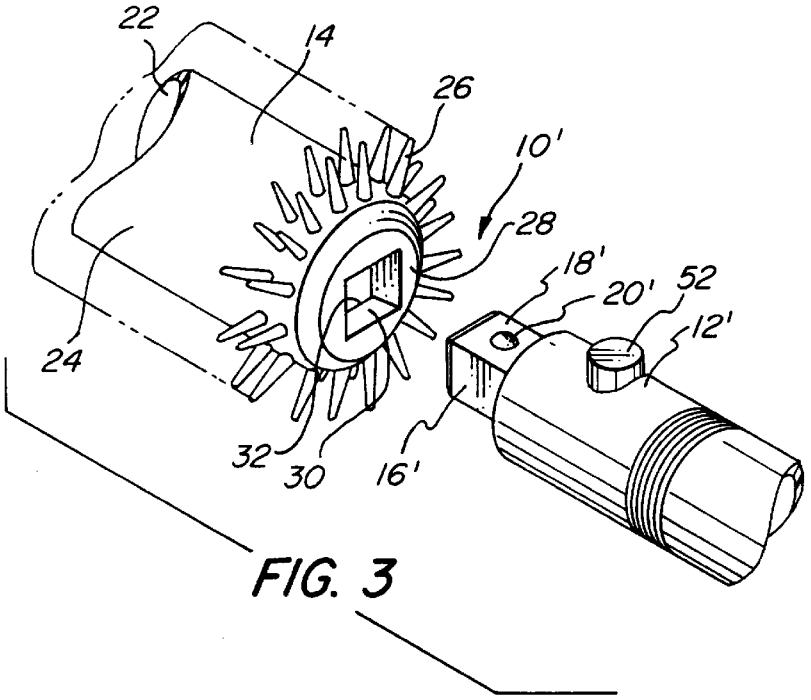
FIG. 3 is an isometric view of a portion of another embodiment of a hairbrush in accordance with the present invention shown with the brush head detached from the handle and with a portion of the bristles cur away; and, FIG. 4 is a partially cross-sectional view of a portion of the hairbrush of FIG. 3 shown with the brush head attached to the handle.
Figure 4:
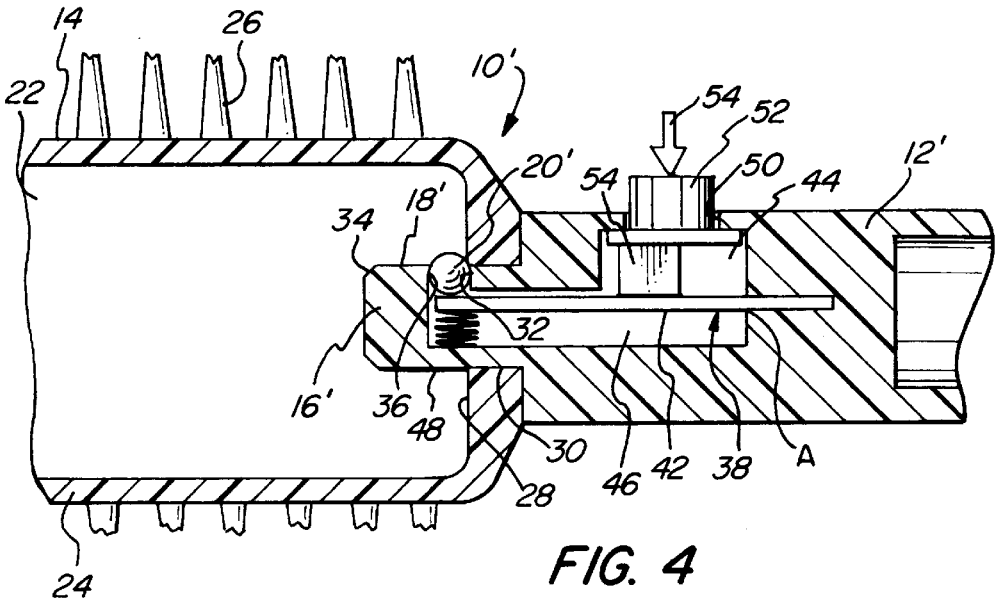

Referring now to FIGS. 3 and 4, a second embodiment of the invention is shown. Hairbrush 10' is comprised generally of handle 12' and brush head 14. Brush head 14 is substantially the same as described above, comprising central core 22 having an outer longitudinal surface 24 with a plurality of radially oriented bristles 26 attached thereto, and also having an end wall 28. As above, end wall 28 defines a socket 30 which is sized and shaped to receive a socket tool 16', and socket 30 defines a ridge 32.

As is the case with handle 12, handle 12' is sized and shaped to fit easily within the grasp of a user, with numerous configurations being possible. Extending from an end of handle 12' is a polygonal socket tool 16' having a plurality of side walls 18', as described above. A detent 20', preferably a spring loaded ball detent, protrudes from one of side walls 18' of socket tool 16'. By spring loaded ball detent, what is meant is a generally spherical member 34 disposed within socket tool 16' such that the member 34 is biased toward a hole 36 in one of side walls 18' so that a portion of the member 34 protrudes through hole 36, and such that member 34 is movable against the bias so that substantially no portion of member 34 protrudes through hole 36.

Hairbrush 10' further includes a retraction mechanism 38 for retracting detent 20'. Although numerous designs for retraction mechanism 38 are possible, FIG. 4 illustrates one such design. Handle 12' defines a chamber 40 which extends at least part of the way into socket tool 16'. A tongue 42 is disposed within chamber 40 and attached to handle 12' at one end such that tongue 42 extends out from its attachment point A with handle 12' into the portion of the chamber located within socket tool 16', thereby dividing chamber 40 into an upper portion 44 and a lower portion 46. Tongue 42 may be deflected about attachment point A. Disposed in lower portion 46 of chamber 40 between tongue 42 and the bottom wall of chamber 40 is a spring 48 which acts to bias tongue 42 toward a normal position. Detent 20' is disposed within hole 36 in side wall 18' and is held therein by tongue 42. When tongue 42 is in the normal position, detent 20' protrudes through side wall 18'.

A hole 50 passes through an outer longitudinal surface of handle 12' proximate to upper portion 44 of chamber 40. A push button 52 is disposed within upper portion 44 of chamber 40 proximate to hole 50. Disposed within upper portion 44 of chamber 40 between button 52 and tongue 42 is an intermediate member 54. Intermediate member 54 may itself constitute a separate element or may be integrally formed as part of button 52 or tongue 42. Button 52 and intermediate member 54 are arranged so that when tongue 42 is in the normal position, a portion of button 52 extends out from hole 50.

When a brush head 14 is to be attached to handle 12', button 52 is depressed (indicated by arrow 56 in FIG. 4). This causes a force to be exerted on tongue 42 through intermediate member 54, which force causes tongue 42 to deflect downward about attachment point A against the bias of spring 48. It should be noted that tongue 42 may itself have such elastic properties that no spring 48 is required, and that tongue 42 may itself act to bias itself to the normal position. As tongue 52 deflects downward, detent 20' is retracted such that substantially no portion of detent 20' protrudes through side wall 18'. Socket tool 16' may now be inserted into socket 30 easily and with substantially no force necessary. Once fully inserted, button 52 is released, causing tongue 42 to return to the normal position, in turn causing a portion of detent 20' to protrude through side wall 18' and engage ridge 32, thereby holding brush head 14 onto handle 12'. Detachment of brush head 14 from handle 12' is accomplished in the same way. Button 52 is pressed, thereby causing detent 20' to retract so that detent 20' no longer engages ridge 32, and handle 12' may be removed from brush head 14 with substantially no force. Thus, in addition to the benefits described above with respect to the previously discussed embodiment, this embodiment allows for separation of brush head 14 and handle 12' without requiring a substantial force, and also allows for separation of handle 12' from brush head 14 with one hand.

Detachable hairbrush 10, 10' is particularly useful as part of a hair curling system. A plurality of brush heads, preferably of various sizes, may be provided so that the brush heads may be used as curlers. To use hairbrush 10, 10' in such a fashion, the handle is attached to one of the plurality of curlers (i.e., brush heads) by inserting the socket tool of the handle into the socket of the one of the plurality of curlers such that the ball detent engages the ridge defined by the socket. The attached curler is then rolled into the hair and the handle detached. The handle is then attached to another of the plurality of curlers, the attached curler is rolled into the hair, the handle is detached, and the steps are repeated until the desired number of curlers are rolled into the hair.

The present invention, therefore, provides a hairbrush which includes a brush head that is detachable from the handle whereby numerous brush heads may be rolled into the hair and the handle removed such that the detached brush heads may act as curlers, which allows for quick and easy separation of the handle and the brush head, which inhibits the brush head from rotating about the handle, which inhibits separation of the brush head from the handle before detachment is desired, which allows for separation of the brush head and handle without requiring a substantial force, and which allows for separation of the handle from the brush head with one hand so that another brush head can be held ready in the other hand.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A hairbrush comprising:

a handle;

a socket tool extending from said handle, said socket tool having a plurality of surfaces;

a detent protruding from one of the plurality of surfaces of said socket tool;

a brush head having a central core, the central core having an end wall;

a socket formed in the end wall of the central core, said socket having a plurality of walls and being sized and shaped to receive said socket tool such that the surfaces of said socket tool contact the walls of said socket thereby inhibiting said brush head from rotating about said handle; and a ridge formed in said socket, whereby said detent engages said ridge when said socket tool is inserted in said socket thereby inhibiting separation of said brush head from said handle before detachment is desired.

2. The hairbrush of claim 1 further comprising a retraction mechanism for retracting said detent so that when said retraction mechanism is actuated, said detent no longer engages said ridge, thereby allowing for separation of the brush head and handle without requiring a substantial force so that said handle may be separated from said brush head with one hand.

3. The hairbrush of claim 2 wherein said retraction mechanism comprises a button protruding through an outer longitudinal surface of said handle and wherein said detent is retracted when said button is depressed.

4. The hairbrush of claim 1 wherein said socket tool comprises a square socket tool.

5. The hairbrush of claim 1 wherein said detent comprises a spring loaded ball detent.

6. A hair curling system comprising:

a handle;

a socket tool extending from said handle, said socket tool having a plurality of surfaces;

a detent protruding from one of the plurality of surfaces of said socket tool;

a retraction mechanism for retracting said detent;

a plurality of curlers, each of said curlers having a central core;

a socket formed in the end wall of the central core of each of said curlers, said socket being sized and shaped to receive said socket tool; and a ridge formed in said socket, whereby said detent engages said ridge when said socket tool is inserted in said socket, and whereby said detent does not engage said ridge when said detent is retracted by said retraction mechanism.

7. The hair curling system of claim 6 wherein said retraction mechanism comprises a button protruding through an outer longitudinal surface of said handle and wherein said detent is retracted when said button is depressed.

8. The hair curling system of claim 6 wherein said socket tool comprises a square socket tool.

9. The hair curling system of claim 6 wherein said detent comprises a spring loaded ball detent.

10. The hair curling system of claim 6 wherein said plurality of curlers comprises a plurality of curlers of various sizes.

11. A method for curling hair comprising the steps of:

providing a handle having a polygonal socket tool extending therefrom, the socket tool having a plurality of surfaces and also having a ball detent protruding through one of the plurality of surfaces;

providing a plurality of curlers having a central core, the central core having an end wall with a socket formed therein, the socket having a plurality of walls and being sized and shaped to receive the socket tool of the handle such that the surfaces of said socket tool contact the walls of said socket thereby inhibiting said brush head from rotating about said handle;

attaching the handle to one of the plurality of curlers by inserting the socket tool of the handle into the socket of the one of the plurality of curlers such that the ball detent engages a ridge formed in the socket thereby inhibiting separation of said brush head from said handle before detachment is desired;

rolling the one of the plurality of curlers attached to the handle into the hair;

detaching the handle from the one of the plurality of curlers rolled into the hair; and attaching the handle to another of the plurality of curlers, rolling the another of the plurality of curlers into the hair, detaching the handle from the another of the plurality of curlers, and repeating such steps until a desired number of curlers are rolled into the hair.

12. The method for curling hair of claim 11 further comprising the step, before the detaching step, of retracting the ball detent to disengage the ball detent from the ridge thereby allowing for separation of the brush head and handle without requiring a substantial force so that said handle may be separated from said brush head with one hand.

* * * * *